United States Patent [19]

Hahm et al.

[11] 4,078,740

[45] Mar. 14, 1978

[54] YARN PACKAGE CARRIER

[76] Inventors: Gerhard Herbert Hahm, 8, Carla-Siedlung, Aachen; Walter Henning, 1, Hermann-Lons-Strasse, Alsdorf-Begau, both of Germany

[21] Appl. No.: 627,011

[22] Filed: Oct. 29, 1975

[30] Foreign Application Priority Data

Nov. 2, 1974 Germany ..... 2452127

[51] Int. Cl.[2] ..... B65H 75/10

[52] U.S. Cl. ..... 242/118.11

[58] Field of Search ..... 242/118.1, 118.11, 118.41, 242/77.2, 110, 118.2; 68/198, 189

[56] References Cited

U.S. PATENT DOCUMENTS

| | | | |
|---|---|---|---|
| 1,779,103 | 10/1930 | Paley | 68/198 |
| 2,936,964 | 5/1960 | Tigges | 242/118.1 |
| 3,307,803 | 3/1967 | Tigges | 242/118.11 |

FOREIGN PATENT DOCUMENTS

| | | | |
|---|---|---|---|
| 1,085,398 | 7/1954 | France | 242/118.1 |
| 851,946 | 10/1952 | Germany | 242/118.1 |

*Primary Examiner*—George F. Mautz

*Attorney, Agent, or Firm*—Mason, Fenwick & Lawrence

[57] ABSTRACT

A yarn package carrier comprising a plurality of parallel extending rod-shaped carrier elements mounted on only one end ring and having free end portions extending axially from the ring, this end ring being provided with apertures adapted in their form and their number to the form and number of the carrier elements, the apertures being positioned to receive the free end portions of another carrier.

4 Claims, 9 Drawing Figures

YARN PACKAGE CARRIER

FIELD OF THE INVENTION

The invention relates to a package carrier having, extending parallel with its axis, rod-shaped carrier elements which project radially outwardly into a common barrel surface and which are attached at only one end ring.

DESCRIPTION OF THE PRIOR ART

Package carriers for thread and yarn packages are already known which can be compressed or pushed together in an axial direction and which are used for the wet treatment of thread and yarn packages, for example for dyeing.

A known package carrier of this type consists of two sleeve parts, each of the same diameter and having disposed at equal distances from one another in a peripheral direction and parallel with the axis, carrier elements, the carrier elements of one sleeve part engaging into interstices between the carrier elements of the other sleeve part.

This known package carrier is very complicated to produce and therefore very expensive.

Furthermore, a package carrier is also known which has only one end ring from which loop-formed carrier elements emerge. The carrier elements which in the case of the known package carrier are made from wire can be so elastically deformed that the end of a package carrier which is remote from the end ring can be introduced into that end of a second package carrier which is provided with an end ring.

Also the manufacture of this known package carrier is quite complicated. What is more, in the case of this package carrier, it is a disadvantage that it cannot be directly wound and has no optimum rotational properties. Furthermore, after compression of the known package carrier, it is not possible to achieve a regular density of the thread or yarn package since the amount by which one package carrier can be pushed into the other is not exactly limited.

SUMMARY OF THE INVENTION

The main object of the present invention resides in developing a package carrier of the type mentioned at the outset to make it particularly simple to produce.

According to the invention, this object is achieved in that in the case of a package carrier of the type mentioned at the outset, there are apertures in the end ring which are adapted substantially to the cross-section of the carrier elements and which correspond in number to the number of carrier elements.

Adaptation of the apertures to the cross-section of the carrier elements is achieved in that although no exact guidance in the apertures is achieved, there is in fact an angular orientation of the adjacent package carriers. Such package carriers can easily be produced, particularly from synthetic plastics material, the material used being dyed in any desired manner to permit of package carrier identification. These package carriers can be directly wound with the known winding frames. Such package carriers can be inserted one into another during transport and storage so that the space required can be considerably reduced.

According to a further proposal of the invention, the apertures in the end ring lie in each case between the attachment points of two adjacent carrier elements.

This is a particularly simple form of embodiment which in addition, for the wet treatment of thread and yarn packages in the compressed state of the packages, provides for equal cross-section through which the treatment medium can flow through and over the entire periphery of the package carrier. If the carrier elements are spaced only a small distance apart from each other, then the dimensions of the apertures may correspond to those of the intermediate spaces between the carrier elements.

A further suggestion according to the invention provides for the carrier elements to be radially outwardly tapering webs. In this way, the moulds used to produce a package carrier from synthetic plastics material can be particularly simple in construction.

According to a further suggestion of the invention, the apertures in the end ring are radially inwardly open.

A further proposal according to the invention provides for the carrier elements, at least in the region of their ends which are remote from the end ring, to be connected by a support ring which is adjacent the radially inwardly directed faces of the carrier elements. Such an inner ring contributes substantially towards raising the inherent rigidity of the package carrier and furthermore assists the guidance of any two interengaged package carriers.

In accordance with a further suggestion of the invention, there is between end ring and support ring at least one stiffening ring to connect the carrier elements. Such a stiffening ring increases the inherent rigidity of the package carrier and can furthermore serve to determine the amount by which one package carrier can be inserted into another. When the packages disposed on the package carriers are compressed, then, it is possible thereby to guarantee an even density of package such as is required for homogeneous treatment of the thread and yarn packages.

A further embodiment of the invention provides for each carrier element to be divided into two portions, the portion which is towards the end ring having two arms each of which is attached at one end to one side of an aperture of the end ring while its other end merges into the second portion, and in that the apertures are adapted to the cross-section of the second portion. The construction of the package carrier guarantees particularly high rigidity and the amount by which one package carrier can be inserted into another is likewise accurately predetermined.

The rigidity of such a package carrier can be further enhanced if the carrier elements are coupled by one or more stiffening rings.

According to a further proposal of the invention, the end face of the end ring which is remote from the carrier elements is constituted by inclined surfaces which are in each case inclined in opposition to one another and which are adjacent to one another in a peripheral direction. In the case of all forms of embodiment of the package carrier, these oblique faces ensure that the free ends of the carrier elements of one package carrier become automatically and angularly correctly orientated with reference to the apertures in the other package carrier. When the package carriers are pressed together, therefore, it is impossible for the carrier elements of one package carrier not to be introduced into the apertures in the end ring of an adjacent package carrier.

Finally, a further proposal of the invention is that a slide ring be displaceably disposed on those ends of the carrier elements which are remote from the end ring.

This slide ring can above all ensure that when the thread or yarn packages are pressed together, no gaps are formed between the carrier elements of one package carrier and the end ring of the adjacent package carrier, into which the threads of the inner layers of a yarn package can be drawn so that the threads may become destroyed. The slide ring safeguards thereby the end of the thread or yarn package which is remote from the end ring and prevents thread or yarn material slipping off. The slide ring may thereby be so formed that its end face which is towards the carrier elements is constituted by peripherally adjacent but in each case oppositely inclined oblique faces.

BRIEF DESCRIPTION OF THE DRAWINGS

Forms of embodiment of the object of the invention are described in the ensuing part of the description which relates to the attached drawings, in which.

DESCRIPTION OF THE PREFERRED EMBODIMENTS

Figure 3:
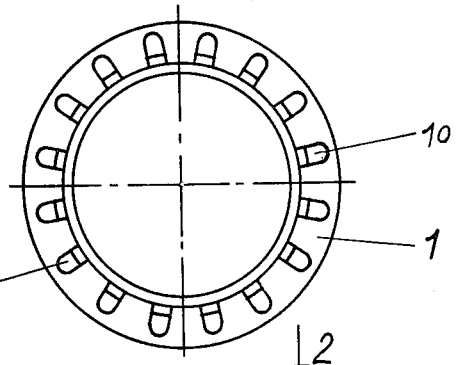
FIG. 3 is a view of the package carrier according to the arrow 3 in FIG. 1.
Figure 1:
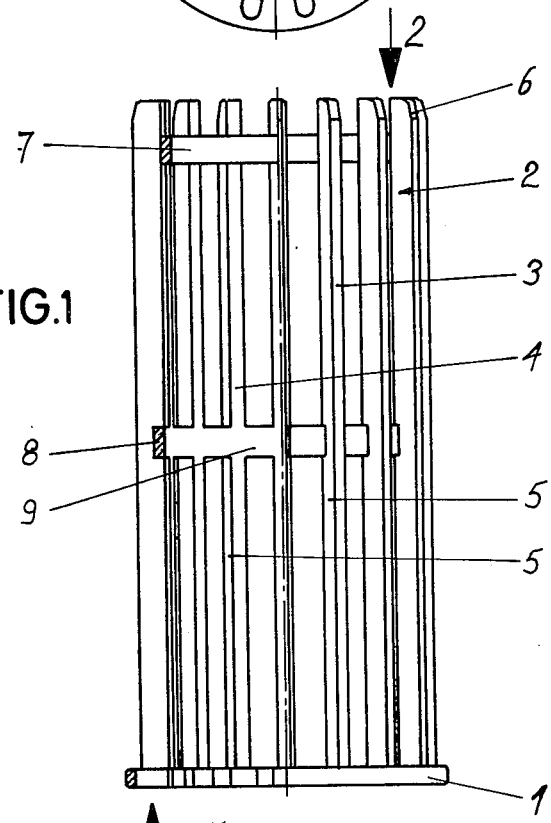
FIG. 1 is a partially sectional view of a first form of package carrier according to the invention, taken on the line 1—1 in FIG. 2.
Figure 2:
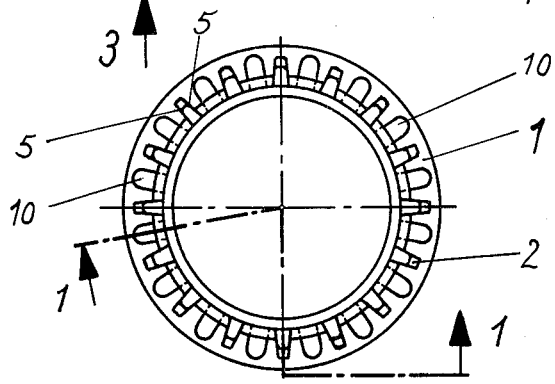
FIG. 2 is a view of the package carrier in the direction of the arrow 2 in FIG. 1.

The form of embodiment of package carrier shown in FIGS. 1 to 3 has an end ring 1 from which a plurality of parallel rod-like carrier slats or webs 2 serving as carrier elements extend parallel with its axis. Each web is constructed symmetrically with respect to a plane extending through the axis of the package carrier and tapers radially outwardly. Thus, each web 2 has a narrow outer face 3 as well as a broader inner face 4. Furthermore, each web 2 has two flank faces 5 which are inclined outwardly towards each other.

The outer faces 3 of all webs 2 have a common cylindrical envelope surface and also the inner faces 4 lie on a common cylindrical surface.

At their end 6 which is remote from the end ring 1, the webs 2 are so chamfered that their radial extension is somewhat reduced. In the region of their free ends 6, they are connected to one another by a support ring 7 which is adjacent the inner faces 4 of the webs 2. The provision of further support rings is possible. Furthermore, a stiffening ring 8 is disposed approximately centrally between the end ring 1 and the support ring 7 to constitute a further connection between adjacent webs 2 and which is itself adjacent the flank faces 5. The stiffening ring 8 has an inner face 9 which lies on the same cylindrical surface as the inner faces 4 of the webs 2. Further stiffening rings may be provided.

As can be seen particularly from FIG. 3, there are in the end ring 1 apertures 10, one aperture 10 lying in each case between the points at which two webs 2 are connected to the end ring 1. Thus, the number of apertures corresponds to the number of webs 2. The apertures 10 are adapted to the cross-section of the webs 2 in such a way that they can in each case accomodate one web 2 of a second package carrier. The cross-section of the apertures 10 is thereby somewhat larger than the cross-section of the webs 2. The apertures 10 are rounded off at their radially outward end and are open in their radially inward end.

Figure 4:
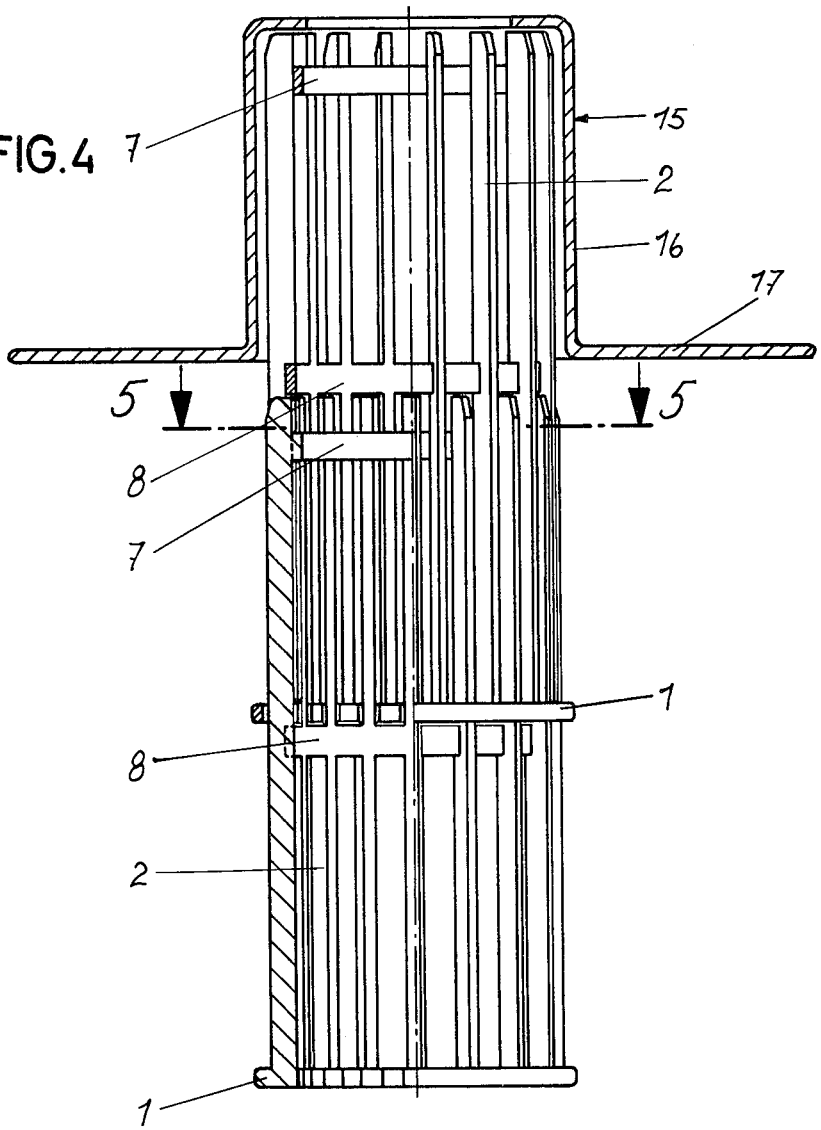
FIG. 4 shows two inter-engaging package carriers constructed according to the invention and according to FIGS. 1 to 3, provided with an end cap.
Figure 5:
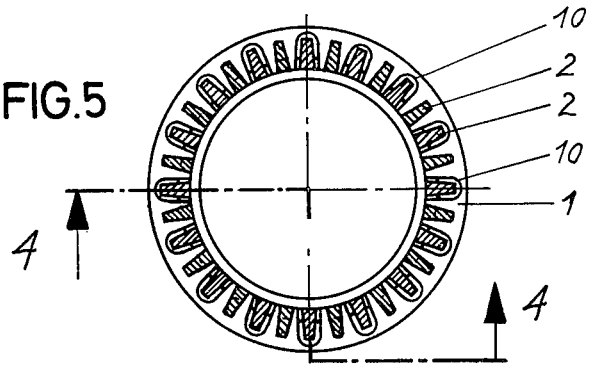
FIG. 5 is a sectional view on the line 5—5 in FIG. 4.

FIGS. 4 and 5 show two package carriers according to the previously described form of embodiment, the webs 2 of the bottom package carrier being inserted through the apertures 10 of a superposed package carrier. Those ends of the web 2 of the bottom package carrier which are remote from the end ring 1 thus lie in each case between the webs 2 of the upper package carrier. The two stiffening rings 8 of the two package carriers prevent the two package carriers being still further inter-engaged beyond the position shown. Thus, when yarn packages which are supported on package carriers of the type described here, are pressed together, an even density of package is achieved which is important for the wet treatment of the packages. A cap 15 having a cylindrical middle portion 16 and an annular flange 17, accomodates those portions of the package carrier which is uppermost when package carriers are inter-engaged, and which are remote from the end ring 1.

FIG. 5 in particular shows that the apertures 10 are not an exact system of guiding the webs 2 of a second package carrier. The sole effect achieved by the packages is that of orientating one package carrier with respect to an adjacent package carrier.

A further form of embodiment of the package carrier according to the invention will now be described with reference to FIGS. 6 and 7. This package carrier has an end ring 21 from which extend carrier elements or slats 22 which run parallel with its axis. The carrier elements are divided in a portion 23 which is adjacent the end ring 21 and in a front portion 24 adjacent thereto. Each carrier element 22 is symmetrically constructed with reference to a plane extending through the axis of the package carrier. At their free ends 25, the front portions 24 are chamfered as has been described in connection with FIGS. 1 to 5. Each carrier element 22 has a continuous outer face 26. The outer faces 26 of all carrier elements 22 lie on one common cylindrical envelope surface. Each carrier element 22 has a radially inwardly directed inner face 27, the inner face of all carrier elements 22 lying on one common cylindrical face.

A support ring 28 connects the carrier elements 22 to one another in the region of their free ends as has likewise already been described with reference to FIGS. 1 to 5.

Those portions 23 of the carrier elements 22 which are adjacent the end ring consist of two parallel arms 29, the arms 29 of one carrier element forming in each case an intermediate space 30, the dimensions of which are larger than the corresponding cross-section of a front portion 24 of a carrier element 22.

In the region of the transition between the portions 23 adjacent the end ring 21, where they merge into the front portions 24, there is a stiffening ring 31 having an inner face 32 which lies on the same cylindrical face as the inner faces 27 of the carrier elements 22.

Provided in the end ring 21 are apertures 33 which are adapted to the cross-section of the front portions 24 of the package carrier and which constitute a continuation of the intermediate space located between the arms 29 of a carrier element 22 and in the region of the end ring 21. Here, too, the apertures 33 are rounded off on their radially outward zone and are radially inwardly open.

Figure 6:
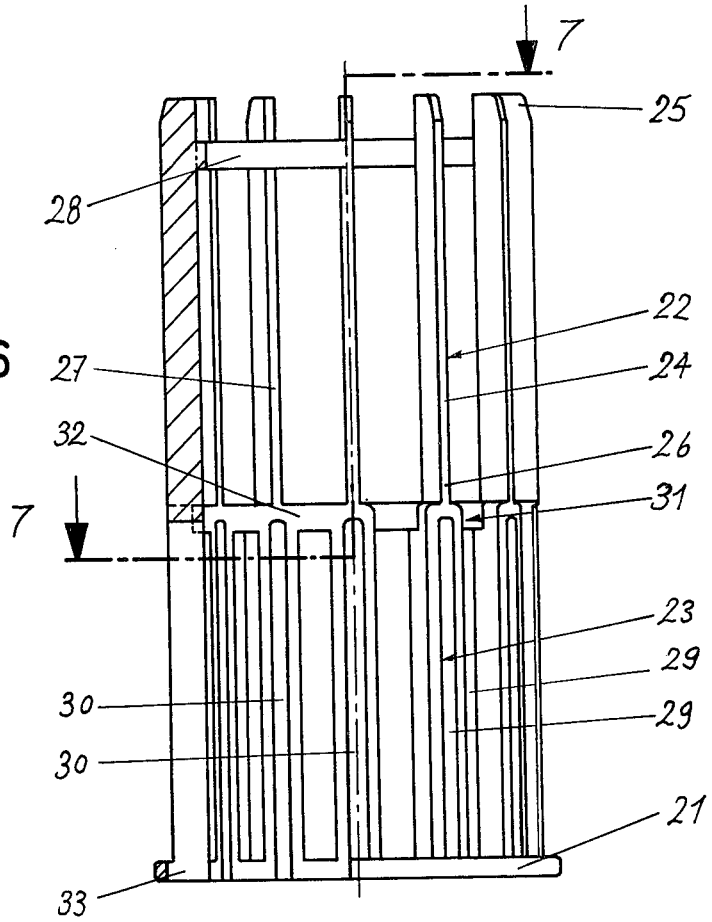
FIG. 6 shows, partly in section, a further form of embodiment of the package carrier according to the invention, taken on the line 6—6 in FIG. 7.
Figure 7:
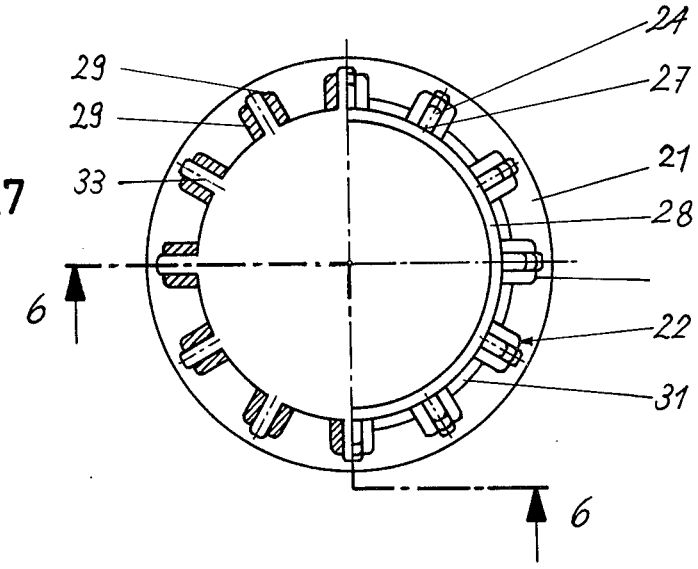
FIG. 7 is a partially sectional view on the line 7—7 in FIG. 6.

Package carriers according to FIGS. 6 and 7 can, in order to reduce space required for transportation and storage, and for compression of the thread or yarn packages which have to be applied on to these package carriers, be inserted into one another, the front portions 24 of one package carrier being inserted through the apertures 33 into the intermediate spaces 30 in another package carrier. Adjacent package carriers can only be inserted into one another by a definite amount.

Figure 8:
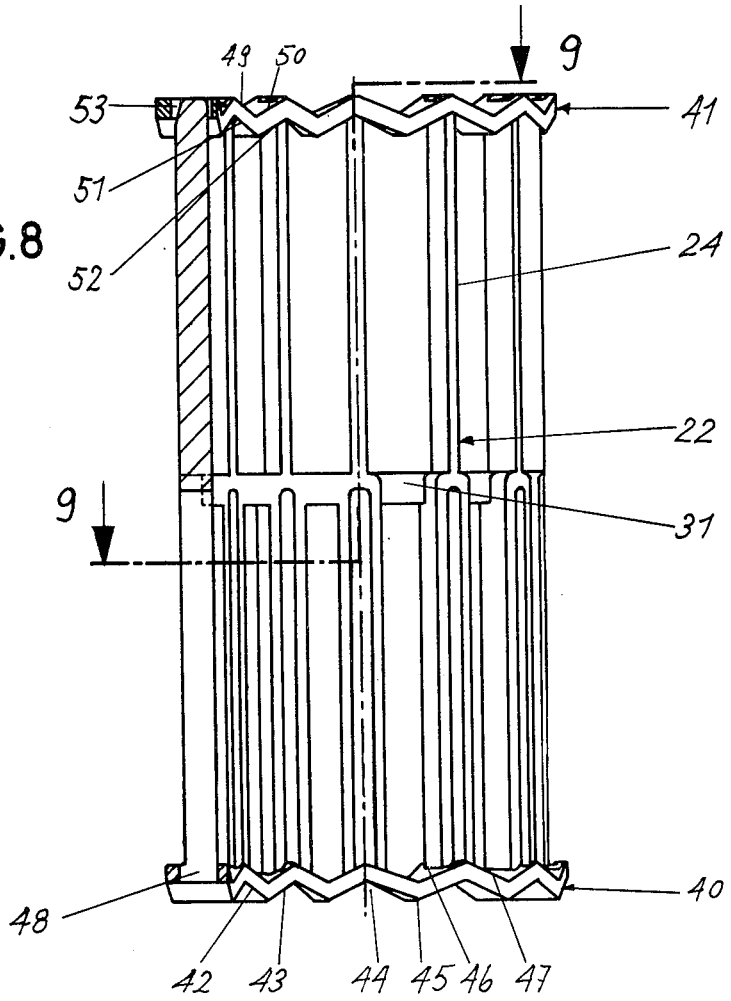
FIG. 8 is a partially sectional view of a third form of embodiment of the package carrier according to the invention, taken on the line 8—8 in FIG. 9.
Figure 9:
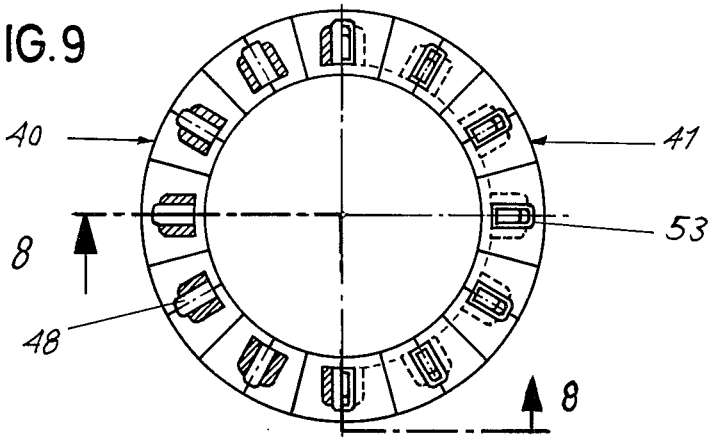
FIG. 9 is a partially sectional view of a package carrier according to the line 9—9 in FIG. 8.

The further form of embodiment of package carrier shown in FIGS. 8 and 9 corresponds very substantially to that previously shown with reference to FIGS. 6 and 7. One difference lies in the fact that the package carrier to be described here has a particularly formed end ring 40 as well as a slide ring 41. The end ring 40 has an end face consisting of adjacently disposed oblique faces 42, 43 which are so inclined with respect to a plane running at right-angles to the longitudinal axis of the package carrier that the lines of intersection of adjacent oblique faces are directed radially in a plane at right-angles to the longitudinal axis. In this way, the end ring 40 has on its end face a serrated profile with depressions 44 and raised parts 45.

The end ring 40 has on its inside which faces the carrier elements 22, further oblique faces 46, 47, the oblique faces 42, 43 on the end face remote from the carrier elements 22 being orientated parallel with the oblique faces 46, 47.

In the end ring 40 are apertures 48 which are constructed according to the apertures 33 in FIGS. 6 and 7. The apertures 48 lie thereby in each case in the depressions 44 in the end face of the end ring 40 so that when two package carriers are inter-engaged, the oblique faces 42, 43 insert the front portions 24 of the carrier elements 22 of a second package carrier into the apertures 48.

The slide ring 41 is displaceably mounted on the front portion 24 of the carrier elements 22. In accordance with the end ring 40, it is built up of adjacently disposed outer oblique faces 49, 50 and inner oblique faces 51, 52. Provided in the slide ring 41 are apertures 53, the cross-section of which is adapted to that of the front portions 24 of the carrier elements 22. The apertures 53 are disposed thereby in those raised portions of the slide ring 41 which are directed away from the end ring 40.

The use of a slide ring 41 excludes the provision of a support ring in the region of movement of the slide ring 41.

Attention should be pointed here to the fact that also the package carrier according to FIGS. 1 to 5 can be equipped with an end ring and with a slide ring according to FIGS. 8 and 9.

The package carriers according to the embodiments described are expediently produced from synthetic plastics material but can, however, also be produced from any other suitable material.

What we claim is:

1. A yarn carrier of generally cylindrical configuration about a longitudinal axis, said carrier comprising a plurality of parallel rod-like carrier slats extending along substantially the entire length of said carrier having ring end portions and free end portions and each being equidistantly spaced from said longitudinal axis and having an outermost extent positioned in an outer cylindrical surface concentric with the longitudinal axis of said carrier, an end ring mounted adjacent and connected to the ring end portions of said carrier slats, a plurality of slat-receiving apertures in said end ring comprising slots extending radially outward from the inner radial extent of said end ring and each aperture being positioned, dimensioned and shaped to receive the free end portion of a carrier slat of another yarn carrier of same construction so that the free end portions of the parallel carrier slats of said other yarn carrier can be interleaved with the ring end portions of said parallel carrier slats by axial movement of said carriers toward each other following axial alignment of the free end portions of said slats of said other carrier with said apertures.

2. A yarn carrier of generally cylindrical configuration about a longitudinal axis, said carrier comprising a plurality of parallel rod-like carrier slats extending along substantially the entire length of said carrier having ring end portions and free end portions and each being equidistantly spaced from said longitudinal axis and having an outermost radial extent positioned in an outer cylindrical surface concentric with the longitudinal axis of said carrier, an end ring mounted adjacent and connected to the ring end portions of said carrier slats, a plurality of slat-receiving apertures in said end ring each positioned, dimensioned and shaped to receive the free end portion of a carrier slat of another yarn carrier of said construction so that the free end portions of the parallel carrier slats of said other yarn carrier can be interleaved with the ring end portions of said parallel carrier slats by axial movement of said carriers toward each other following axial alignment of the free end portions of said slats of said other carrier with said apertures and wherein said parallel slats include a pair of parallel ring-end slat portions for each free end slat portion with the ring end slat portions being spaced to receive the free end portions of the slats of said other carrier.

3. The carrier of claim 2 wherein said end ring consists of a plurality of oppositely inclined adjacent oblique faces respectively joined along radial lines with respect to said longitudinal axis.

4. The carrier of claim 3 additionally including a slide ring mounted for sliding movement in an axial direction on said free end portions of said slats.

* * * * *